US006099327A

United States Patent [19]

Chen

[11] Patent Number: 6,099,327

[45] Date of Patent: Aug. 8, 2000

[54] ELECTRICAL CONNECTOR

[75] Inventor: Chu-Mei Chen, Taipei, Taiwan

[73] Assignee: Hon Hai Precision Ind. Co., Ltd., Taipei Hsien, Taiwan

[21] Appl. No.: 09/357,780

[22] Filed: Jul. 21, 1999

[30] Foreign Application Priority Data

Dec. 31, 1998 [TW] Taiwan ..... 87222081

[51] Int. Cl.[7] ..... H01R 13/648

[52] U.S. Cl. ..... 439/95; 439/607

[58] Field of Search ..... 439/95, 607, 609, 439/939

[56] References Cited

U.S. PATENT DOCUMENTS 4,337,989 7/1982 Asick et al. ..... 439/609
5,073,130 12/1991 Nakamura ..... 439/607
5,286,210 2/1994 Kilsdonk et al. ..... 439/95
5,466,175 11/1995 Onoda ..... 439/95
5,496,185 3/1996 Beak ..... 439/95
5,622,523 4/1997 Kan et al. ..... 439/939

*Primary Examiner*—Gary F. Paumen
*Attorney, Agent, or Firm*—Wei Te Chung

[57] ABSTRACT

An electrical connector comprises a dielectric body defining a number of passageways for receiving a number of contacts therein, a conductive shield cover enclosing the body, a dielectric housing enclosing the shield cover, and a conductive grounding member disposed between the shield cover and the dielectric housing for providing a grounding path therebetween and electrically contacting a conductive housing of an electrical instrument to which the electrical connector is fixed. A conductive resilient member is mounted on the body and forms latching mechanism for engaging with a mating connector thereby preventing the mating connector from disengagement and for providing a grounding path therethrough.

6 Claims, 9 Drawing Sheets

ELECTRICAL CONNECTOR

BACKGROUND OF THE INVENTION

The present invention relates to an electrical connector, and particularly to an electrical connector for reliably connecting with a mating connector and for providing excellent shielding and grounding effects.

Nowadays, a greater demand is being placed on electronic devices to be multi-functional. Thus, a high density of electrical elements are required to be assembled within the device, which increases electromagnetic interference between components thereby adversely affecting signal transmission. An electrical connector is used for transmitting signals between electronic devices. A shielding system is commonly assembled with the connector to minimize the effects of electromagnetic interference and ensuring proper signal transmission.

A conventional shielding system is disclosed in U.S. Pat. No. 4,337,989. Referring to FIG. 1, an electrical connector 1' comprises a U-shaped shield cover 3' enclosing the electrical connector 1'. The shield cover 3' is a component of a shielding system for shielding the connector 1' from outer electromagnetic interference. The shield cover 3' forms a pair of mounting plates 5' and an aperture 7' is formed in each mounting plate 5'. The shield cover 3' encloses a dielectric body 10' and is then mounted to a mating circuit board 9'. A metal sheet 90' covers the circuit board 9'. The sheet 90' defines a pair of screw holes 91' corresponding to the apertures 7' of the shield cover 3', and a plurality of receiving holes 92' for receiving corresponding tail portions 11' of terminals 12' fixed in the body 10'. Thus, the housing 3' can be screwed to the circuit board 9' through the mounting apertures 7' and the corresponding screw holes 91' thereby achieving good shielding effects. However, the screw mounting mode results in low manufacturing efficiency. Moreover, the mounting plates 7' occupy additional space on the circuit board 9' thereby limiting circuitry layers of the circuit board 9'.

An integrate type of shielding system, disclosed in U.S. Pat. No. 5,073,130 and Taiwan Patent Application No. 81110335, includes a housing enclosing a dielectric body of an electrical connector receiving a plurality of contacts therein and commonly forming a pair of grounding legs. The grounding legs are inserted into a mating circuit board thereby forming a grounding circuit to discharge static electricity via the circuit board. Such a shielding system can achieve good shielding and grounding effects. However, the grounding legs are unable to quickly discharge the large quantity of static electricity produced by newly developed high frequency electrical elements. Therefore, a large quantity of static electricity may accumulate in electrical connectors and may produce sparks via any tines formed on the electrical connector, thereby damaging the electrical connectors and the mating circuit board. Moreover, the retention force provided by the grounding legs is insufficient for properly fixing the electrical connector to the mating circuit board. Thus, reliable and stable signal transmission between the connector and the mating circuit board can not be ensured. Furthermore, contacts of conventional connectors may become deformed at free ends thereby adversely affecting the stability of signal transmission.

BRIEF SUMMARY OF THE INVENTION

The main object of the present invention is to provide an electrical connector for achieving reliable shielding effects and effective discharge of static electricity.

Another object of the present invention is to provide an electrical connector which can assure a mating connector with a reliable electrical connection.

An electrical connector in accordance with a preferred embodiment of the present invention comprises a dielectric body, a plurality of contacts received in the body, a conductive shield cover, a spacer and a dielectric housing. The dielectric housing encloses a subassembly consisting of the body, the contacts, the shield cover and the spacer, and fixes the connector of the present invention onto a circuit board. A resilient member is attached to the body for further engaging a mating plug connector with the connector of the present invention. A grounding member is attached between the shield cover and the dielectric housing for forming a grounding path to connect with an outer grounding circuit.

The body forms a plurality of passageways. A wedge is formed at a front end of each passageway for preventing a free end of the corresponding contact from deforming and extending beyond the passageway. An opening is defined in communication with each passageway for permitting movement of the contact received therein.

Other objects, advantages and novel features of the invention will become more apparent from the following detailed description when taken in conjunction with the accompanying drawings.

DETAILED DESCRIPTION OF THE INVENTION

Figure 1:
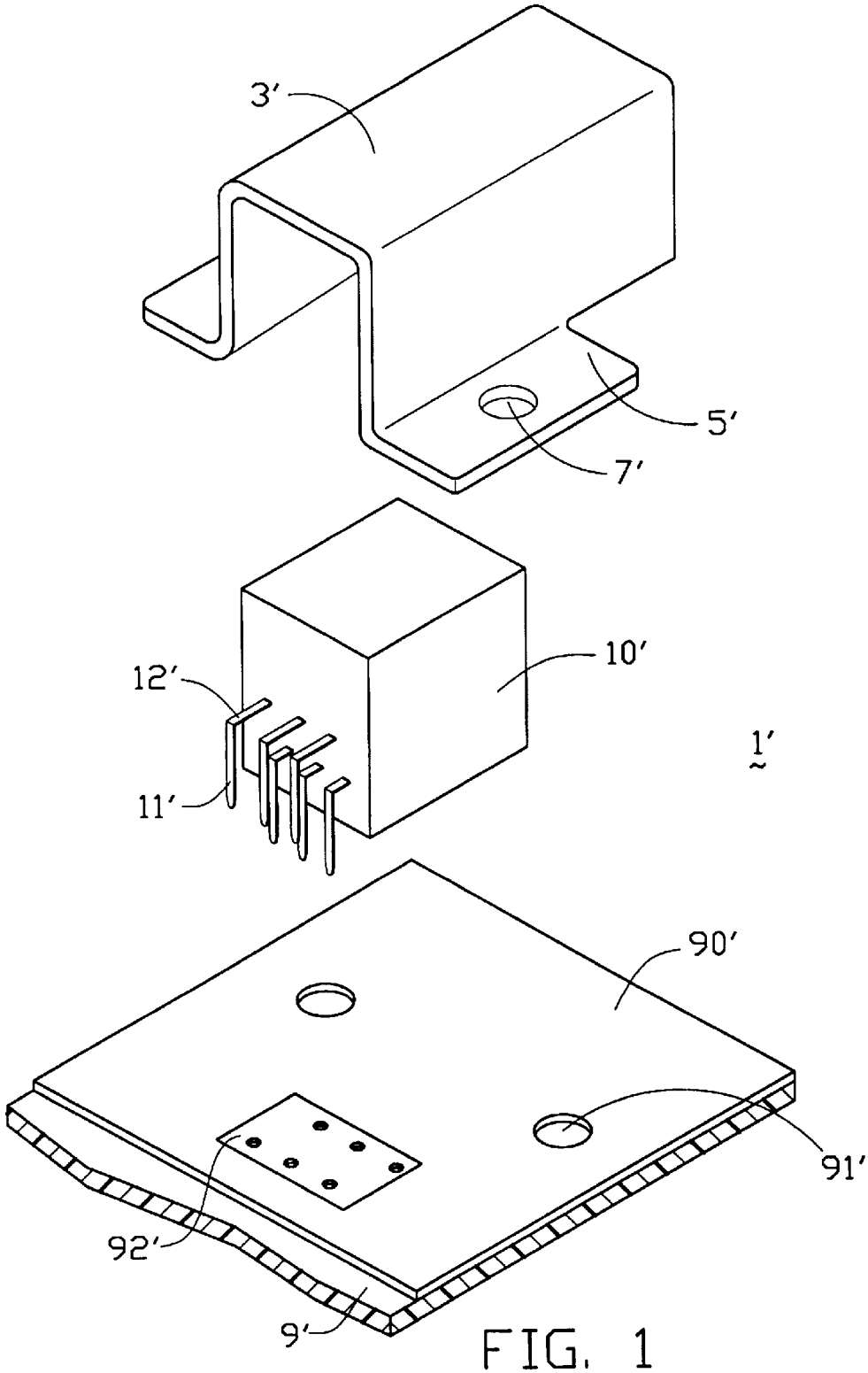
FIG. 1 (PRIOR ART)
FIG. 1 is an exploded view of a conventional electrical connector.
Figure 2:
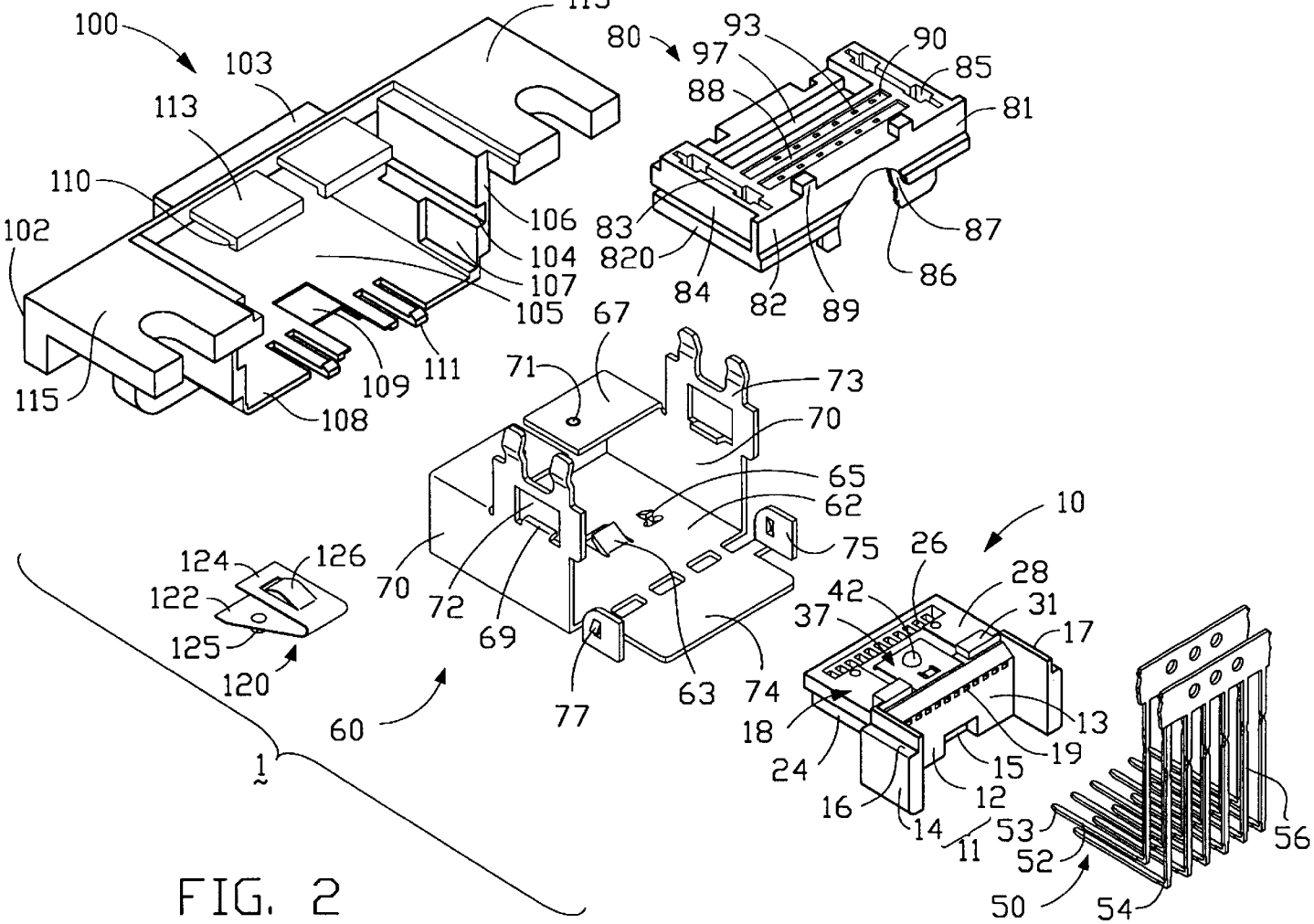
FIG. 2 is an exploded view of an electrical connector in accordance with the present invention.

Referring to FIG. 2, an electrical connector 1 in accordance with the present invention comprises a dielectric body 10 having a conductive resilient member 37 mounted thereon, a plurality of contacts 50 received in the body 10, a shield cover 60 for enclosing the body 10 therein, a spacer 80 for properly spacing the contacts 50, a dielectric housing 100 for encasing a subassembly consisting of all components enumerated above, and a grounding member 120 attached between the dielectric housing 100 and the shield cover 60.

Figure 3:
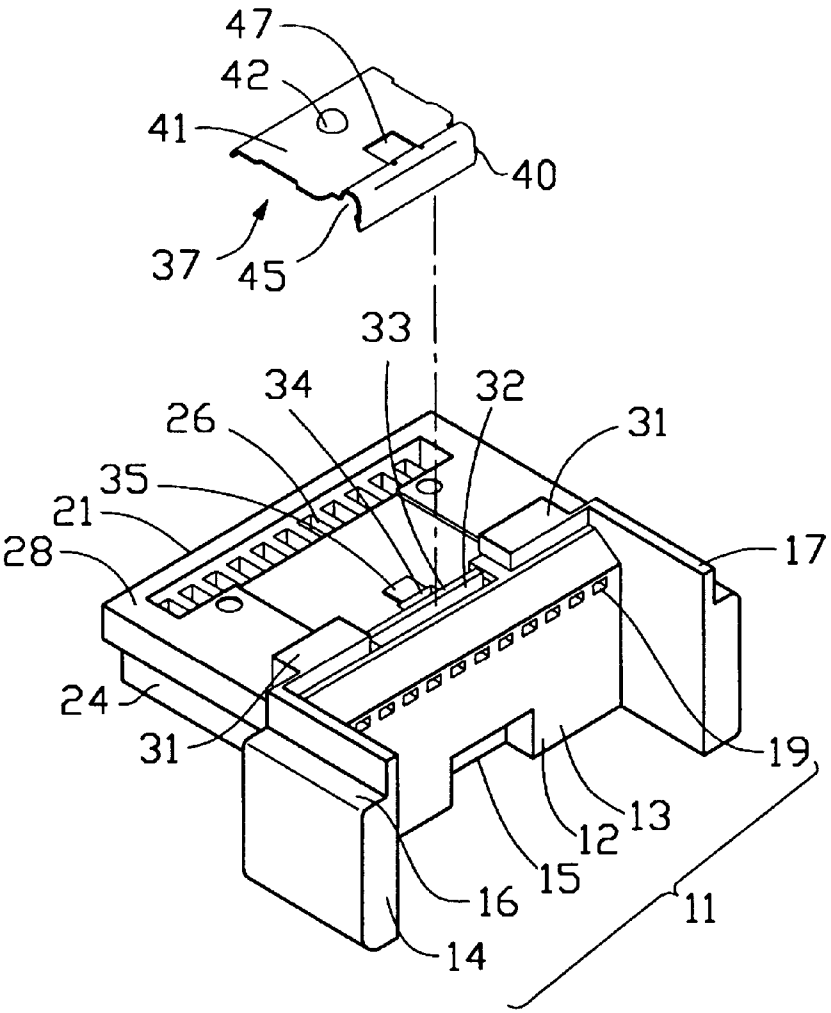
FIG. 3 is an exploded view of a dielectric body and a resilient member of the present electrical connector.
Figure 5:
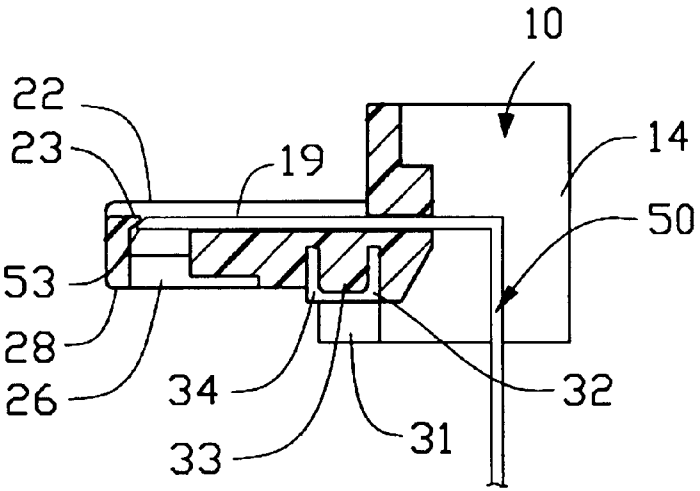
FIG. 5 is a cross sectional view of the dielectric body taken along line V—V of FIG. 4, with contacts assembled therein.
Figure 4:
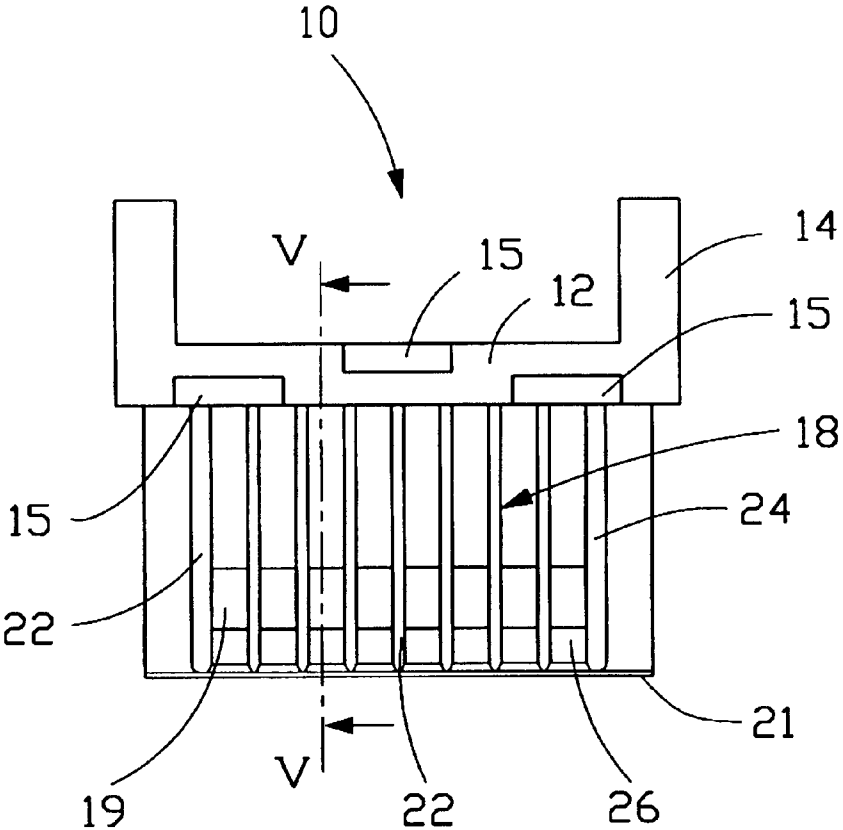
FIG. 4 is a bottom plan view of the dielectric body.

Referring also to FIGS. 3, 4, and 5, the body 10 is insert molded from insulative material and comprises a U-shaped joining portion 11. The joining portion 11 includes a middle member 12, and a pair of side members 14 perpendicularly extending from opposite sides of the middle member 12. Three recesses 15 are defined in a top surface of the middle member 12 for engaging with the shield cover 60. One of the recesses 15 is offset from the other two. Each side member 14 forms a bottom flange 17 for engaging with the spacer 80 and a step surface 16 for engaging with the shield cover 60.

A mating portion 18 extends from the middle member 12 away from the side members 14. The mating portion 18 has a front wall 21 adjacent to a joining face 28. A plurality of passageways 19 are defined between the front wall 21 of the mating portion 18 and a rear face 13 of the joining portion 11 for receiving the corresponding contacts 50 therein. A pair of lateral ribs 24 integrally extends downwardly proximate opposite edges of the mating portion 18 thereby defining a mating surface 22. The front wall 21 forms a wedge 23 at an end of each passageway 19 proximate the mating surface 22 for preventing a free end 53 of the corresponding contact 50 from deforming and extending beyond outside of the passageway 19. A channel 26 is defined proximate each wedge 23 between the mating surface 22 and the joining surface 28 for providing the free end 53 of the corresponding contacts 50 with sufficient clearance for promoting movement thereof. When the contacts 50 are inserted into the corresponding passageways 19, the channels 26 allow the free end 53 of the corresponding contacts 50 to abut against the corresponding wedges 23 thereby protecting the contacts 50 from deformation.

A pair of blocks 31 integrally extend inward from the bottom flanges 17 of the side members 14. A bottom surface of each block 31 is coplanar with the corresponding bottom flange 17. A beam 33 is formed between the two blocks 31 and defines two latching slots 32, 34 on opposite sides thereof. A bump 35 protrudes from the joining face 28 adjacent to the latching slot 34.

The resilient member 37 is stamped and formed from a metal sheet or other suitable conductive material. The resilient member 37 comprises a main body 41 forming latching means thereon for engaging with a mating plug connector 130 (FIG. 9), and a clasp portion 40 arcuately extending from a lateral edge of the main body 41 thereby defining a clasping space 45. The latching means comprises a nose 42 outwardly protruding from the main body 41. The clasp portion 40 forms barbs (not labeled) on opposite edges thereof for interferentially fitting into the latching slots 32, 34, while the clasping space 45 receives the beam 33 therein. An aperture 47 is defined proximate the clasp portion 40 for extension of the bump 35 of the body 10 therethrough. Thus, the resilient member 37 is fixed to the body 10.

Each contact 50 is L-shaped and comprises a mating end 52 for connecting with the mating plug connector 130 and a connecting end 56 for connection with a circuit board (not shown). The connecting end 56 is perpendicular to the mating end 52. A pair of cutouts 54 is defined in opposite edges of a corner joining the connecting end 56 with the mating end 52 for facilitating operation of a tool during insertion of the contacts 50 into the corresponding passageways 19 of the body 10. The mating ends 52 of the contacts 50 are inserted into the corresponding passageways 19, while the free end 53 of each contact 50 abuts against the corresponding wedge 23 of the body 10. The connecting ends 56 of the contacts 50 are perpendicular to the joining surface 28 of the body 10.

The shield cover 60 comprises a main body 62, a pair of side members 70 integrally extending from opposite edges of the main body 62 and a pair of support members 67 perpendicularly extending from edges of the side members 70. The main body 62 forms a first tab 63 on a middle portion thereof and a pair of second tabs 65 on either side of the first tab 63 for engaging with the corresponding recesses 15 of the body 10. The first and second tabs 63, 65 comprise engaging means for attaching the shield cover 60 to the body 10 thereby preventing the body 10 from vibrating within the shield cover 60.

The support members 67 are symmetric and define a receiving space with the cooperation of the side members 70 for receiving the body 10 therein. Each support members 67 forms a dimple 71 for engaging with the mating plug connector 130. Each side member 70 defines an aperture 72 for engaging with the spacer 80 and forms a clasp 69 extending into the aperture 72 for latching the corresponding step face 16 of the body 10 thereby preventing the body 10 from vertical movement. A pair of grounding lugs 73 extend from bottom edges of each side member 70 for discharging static electricity.

The shield cover 60 also forms a baffle member 74 extending from the main body 62 proximate the side members 70 for obstructing horizontal movement of the body 10. A pair of latching tabs 75 perpendicularly extend from opposite edges of the baffle member 74. Each latching tab 75 forms an outwardly extending barb 77 for abutting against the dielectric housing 100.

Figure 7:
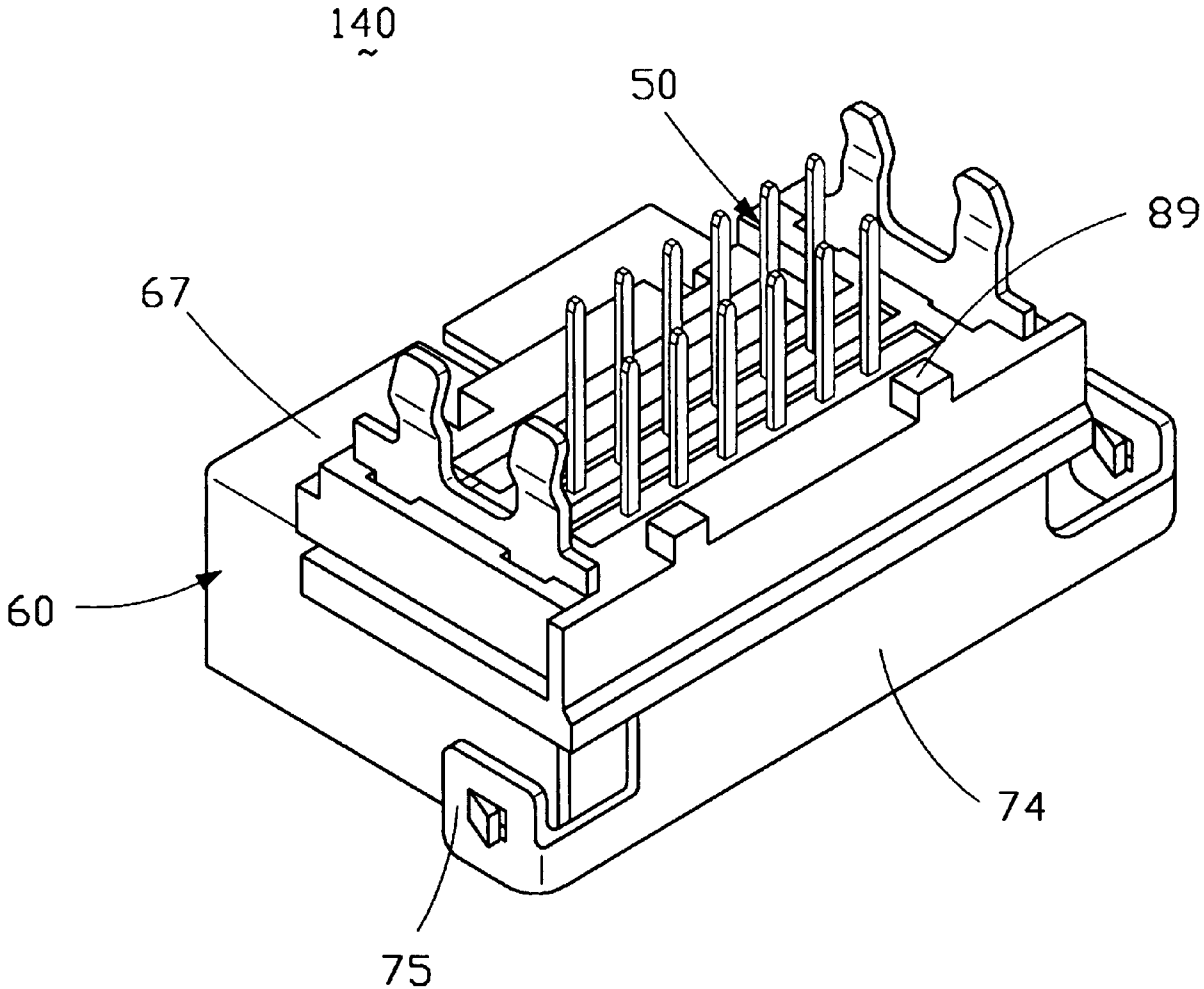
FIG. 7 is similar to FIG. 6 with a spacer assembled therewith.

The spacer 80 is made of dielectric material and comprises a body member 81. A pair of standoffs 89 integrally protrude from a bottom surface of the body member 81 proximate on edge thereof for spacing the connector 1 from a mating circuit board thereby facilitating connection of the contacts 50 with the mating circuit board. A pair of engaging passageways 85 is defined in opposite side portions 84 of the body member 81 for partially receiving the corresponding side members 70 of the shield cover 60 therein, and a protruding block 83 projects from an inner side wall of each engaging passageway 85 for latching within the corresponding apertures 72 of the shield cover 60 just beyond and abutting against the clasp 69 (FIG. 7). A shielding plate 86 is formed between the two side portions 84. An engaging channel 87 is defined between the shielding plate 86 and a rear wall 82 of the body member 81 for interferentially receiving the baffle member 74 of the shield cover 60 therein. A pair of lower extensions 820 outwardly extends from the rear wall 82 for engaging with the dielectric housing 100. Two support recesses 90 are defined in a top wall 88 of the spacer 80 for providing a plurality of engaging slots 93 with proper areas. The engaging slots 93 adapt for receiving the corresponding connecting ends 56 of the contacts 50 therein. A latching groove 97 is defined in the top wall 88 opposite the standoffs 89 for engaging with the dielectric housing 100.

Figure 6:
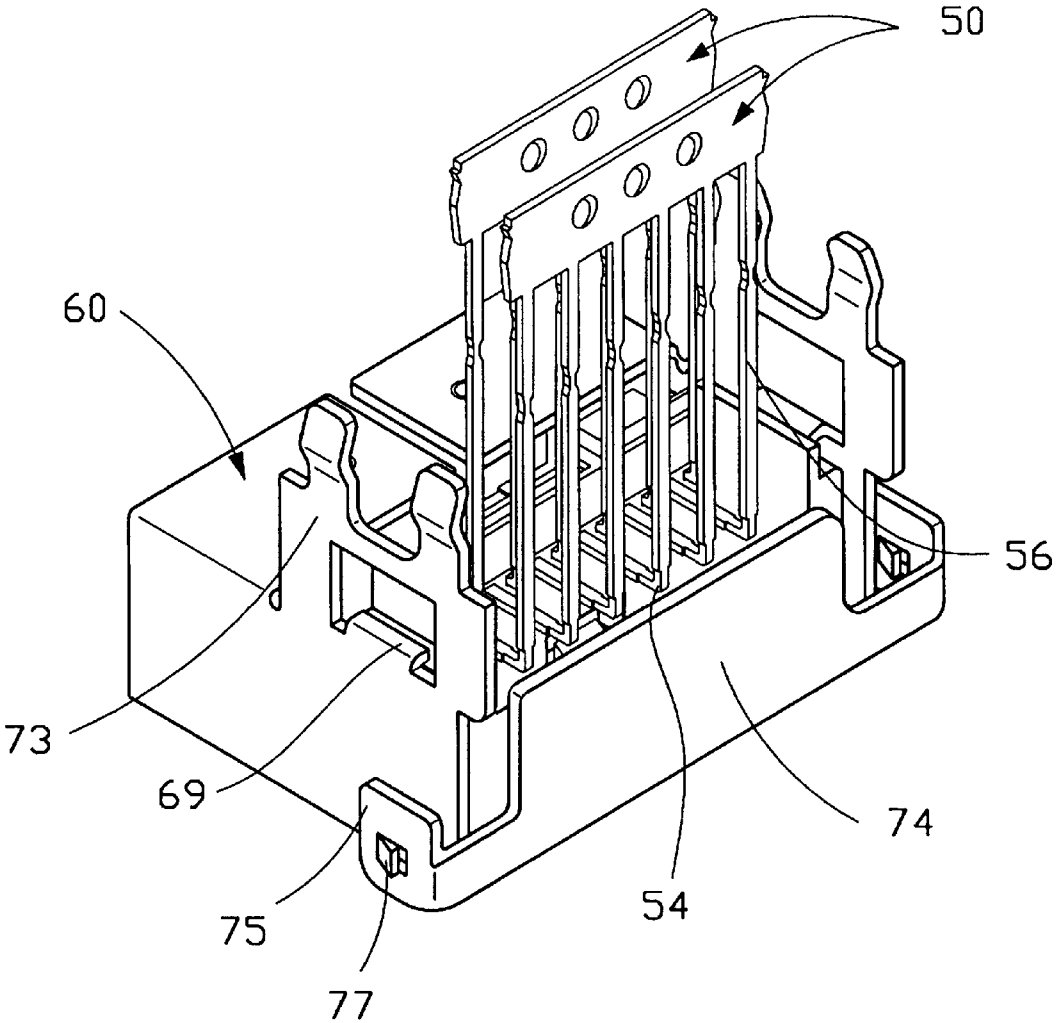
FIG. 6 is a perspective view of the dielectric body with the contacts assembled therein.

In assembly, referring to FIGS. 5, 6, and 7, the contacts 50 with carrier strips cut away are first inserted into the body 10. The mating ends 52 are disposed in the corresponding passageways 19 with the free ends 53 thereof abutting against the corresponding wedges 23, while the connecting ends 56 perpendicularly extend beyond the joining surface 28.

The shield cover 60 is then fixed to the body 10 by engaging with the joining portion 11 whereby the body 10 is received in the receiving space of the shield cover 60. The first and second tabs 63, 65 latch within the corresponding recesses 15 of the body 10. The clasps 69 latch the corresponding step faces 16 of the body 10. The baffle member 67 is then perpendicularly bent, thus, the body 10 is encased in the shield cover 60.

After the body 10 is encased in the shield cover 60, the spacer 80 is assembled to the body 10 and the shield cover 60. The grounding lugs 73 extend through the corresponding engaging passageways 85, while the protruding blocks 83 are anchored within the corresponding apertures 72. The connecting ends 56 of the contacts 50 extend out of the corresponding engaging slots 93. Thus, a subassembly 140 is achieved.

Referring back to FIG. 2, the dielectric housing 100 is molded from a dielectric material and comprises a mating member 103 and a pair of connecting members 115 formed on lateral ends of the dielectric housing 100. The mating member 103 outwardly extends from a middle portion of a front wall 102 for engaging with the mating connector 130. A pair of parallel cantilevers 113 outwardly extend from a rear surface of the front wall 102. Each cantilever 113 forms a hook 110 at a free end thereof for engaging within the groove 97 of the spacer 80. A receiving chamber 105 is defined between the front wall 102, the two connecting members 115, the two cantilevers 113 and a top wall 108 for receiving the subassembly 140 therein.

The top wall 108 joins the two connecting members 115 together via a pair of side walls 106. An engaging groove 104 is defined in each side wall 106 for slidably engaging with the corresponding lower extension 820 of the spacer 80. A side recess 107 is also defined in the side wall 106 below the engaging groove 104 for engaging with the corresponding latching tabs 75 therein with the barbs 77 abutting against the corresponding side walls 106. The top wall 108 defines a notch 109 proximate a rear edge thereof for engaging with the grounding member 120. A pair of engaging ribs 111 are formed on either side of the notch 109 for engaging with the baffle member 74 of the shield cover 60.

The grounding member 120 is then assembled between the dielectric housing 100 and the shield cover 60. The grounding member 120 is made from a resilient metal sheet and has a width substantially equal to the width of the notch 109. The grounding member 120 is folded an appropriate angle and comprises a securing portion 124 for engaging with the notch 109, and a contact portion 122 for electrically contacting a conductive housing of an electronic instrument to which the connector 1 of the present invention is fixed. A bulge 125 is formed on the connecting portion 122 opposite the securing portion 124 for electrically contacting the housing of the electronic instrument. The securing portion 124 forms a contact tab 126 for abutting against the shield cover 60. Thus, a grounding circuit is achieved via the resilient member 37 of the body 10, the shield cover 60, the grounding member 120 and the conductive housing of the electrical instrument to which the connector 1 is fixed.

Figure 8:
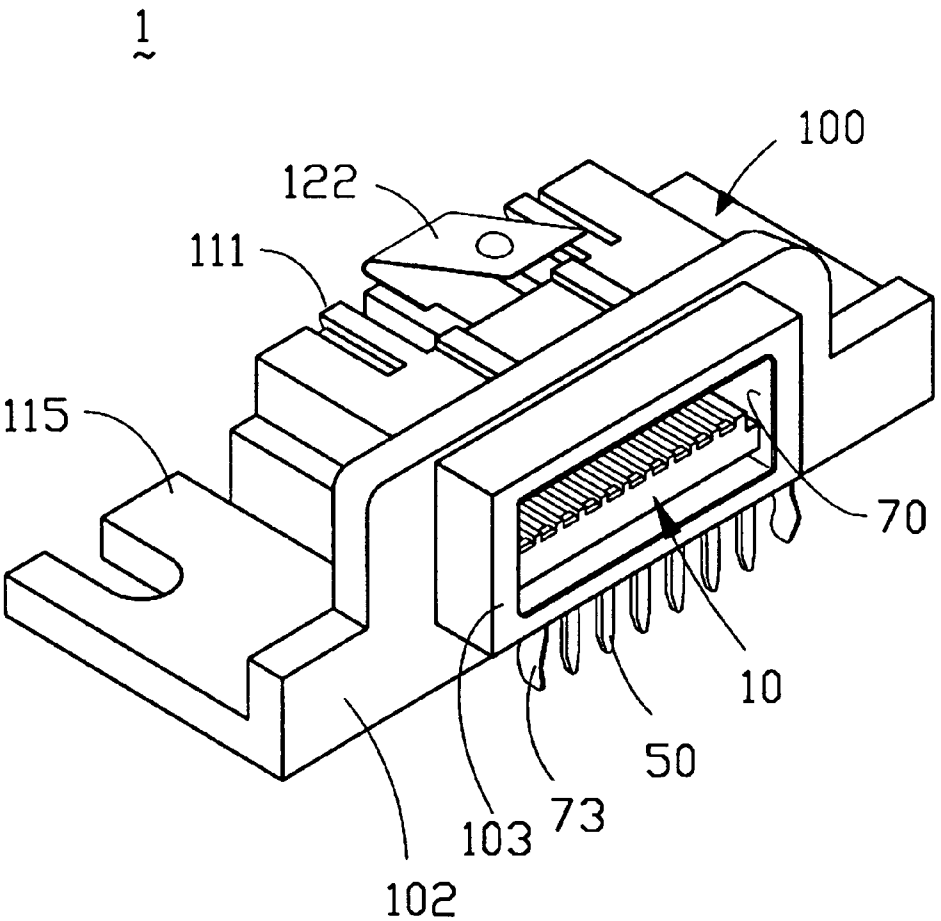
FIG. 8 is an assembled view of the electrical connector of FIG. 2.

As shown in FIG. 8, the electrical connector 1 of the present invention is fully assembled after the dielectric housing 100 encloses the subassembly 140, and the grounding member 120 is fixed between the dielectric housing 100 and the shield cover 60.

Figure 9:
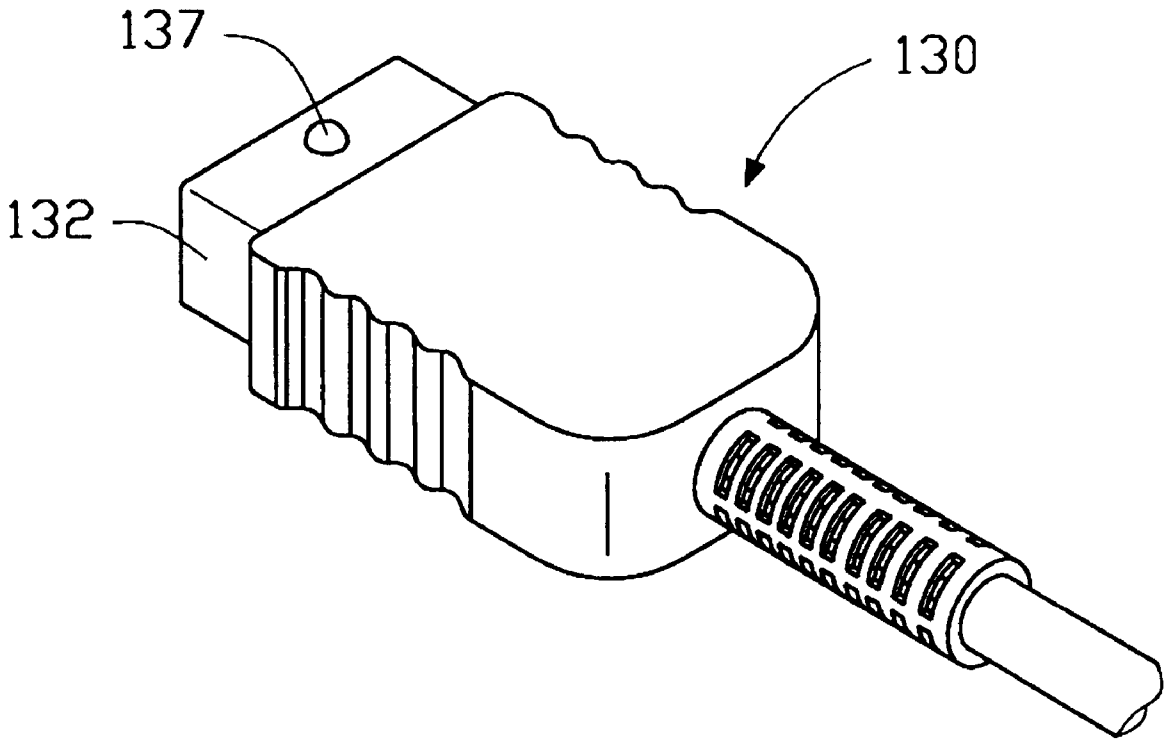
FIG. 9 is a perspective view of a mating electrical connector for mating with the electrical connector of the present invention.
Figure 10:
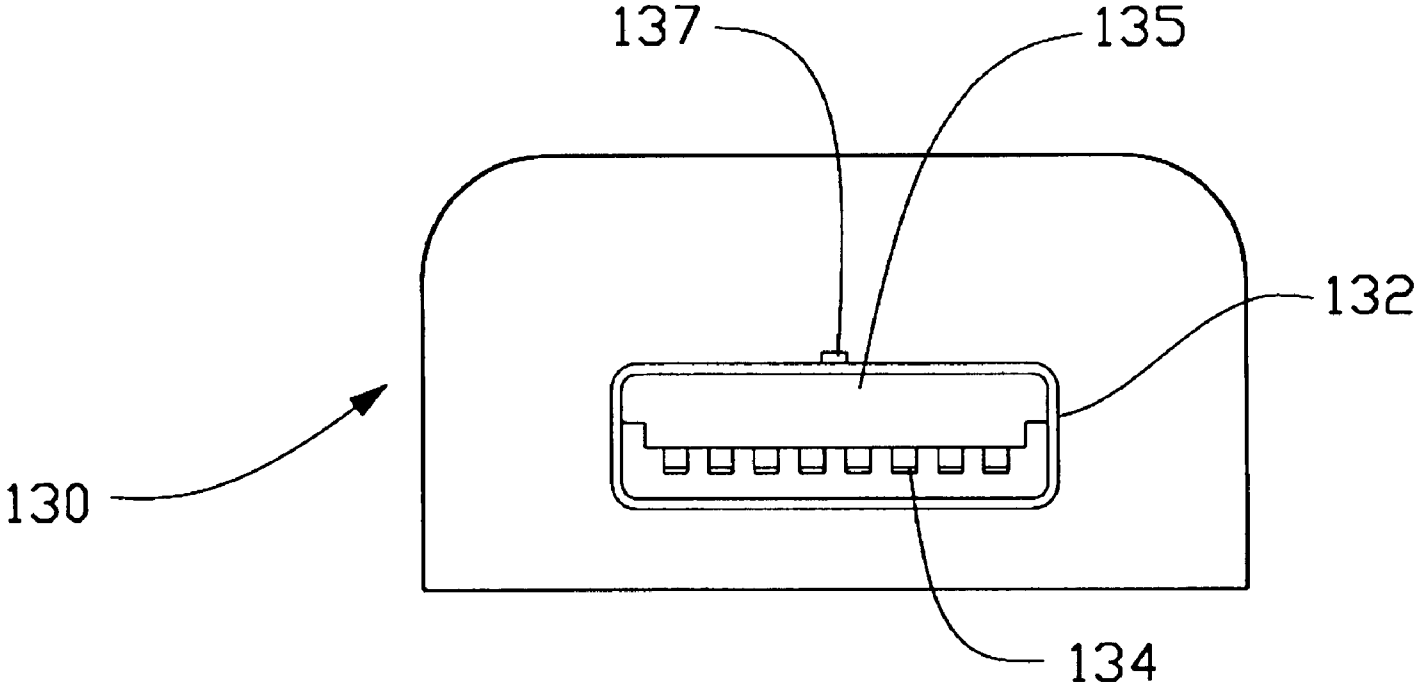
FIG. 10 is a front plan view of FIG. 9.

Referring to FIGS. 9 and 10, the mating plug connector 130 comprises a conductive shield enclosed by an insulative covering. The shield has a plug portion 132 at a front end outside of the insulative covering. The plug portion 132 defines a mating opening 135 in a front face receiving a plurality of terminals 134 therein for mating with the corresponding contacts 50 of the connector 1 of the present invention. A dimple 137 is formed on a surface of the plug portion 132 for engaging with the nose 42 of the resilient member 37 attached to the body 10 thereby preventing the mating connector 130 from disengagement with the connector 1. The dimples 71 formed on the support plates 67 closely abut against the conductive shield of the mating connector 130 for ensuring that the nose 42 of the resilient member 37 engage with the dimple 137 of the mating connector 130.

Therefore, the dimples 71 of the shield cover 60 electrically contact with the conductive shield of the mating connector 130, the grounding member 120 electrically contacts the shield cover 60, and the grounding member 120 then electrically contacts the conductive housing of the electronic instrument to which the connector 1 is fixed. Thus, a grounding circuit is formed to provide the connector 1 and the mating connector 130 with multiple grounding paths for effectively discharging a large quantity of static electricity.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

a dielectric body defining a plurality of passageways therein;

a plurality of contacts received in the passageways;

a conductive shield cover defining a receiving space for enclosing the dielectric body therein;

a dielectric housing comprising a mating member for engaging with a mating plug connector, a pair of connecting members formed on lateral ends, a top wall joining with the mating member, a receiving chamber defined between the mating member, the connecting members and the top wall for receiving the conductive shield cover and the dielectric body therein, and a notch defined in a rear edge of the top wall opposite the mating member; and a conductive grounding member being attached between the conductive shield cover and the dielectric housing, and comprising a securing portion for engaging with the notch of the dielectric housing and a connecting portion for electrically contacting with a conductive housing of an electrical instrument.

2. The electrical connector as claimed in claim 1, wherein the securing portion is folded an appropriate angle relative to the connecting portion and forms a contact tab for electrically contacting the conductive shield cover.

3. The electrical connector as claimed in claim 2, wherein the notch of the dielectric housing has a width substantially equal to the width of the securing portion of the grounding member for latching the securing portion therein.

4. The electrical connector as claimed in claim 1, wherein a bulge is formed on the connecting portion opposite the securing portion for electrically contacting the conductive housing of the electrical instrument.

5. The electrical connector as claimed in claim 1, wherein the conductive shield cover comprises a main body, a pair of side members perpendicularly extending from opposite edges of the main body, and a pair of support plates perpendicularly extending from the side members parallel to the main body, a receiving chamber being defined between the main body, the side members and the support plates for receiving the dielectric body therein.

6. The electrical connector as claimed in claim 5, wherein the support plates of the conductive shield cover are located below the top wall of the dielectric housing proximate the notch whereby the contact tab electrically contacts the support plates.

* * * * *